US005479177A

United States Patent [19]

Rudish et al.

[11] Patent Number: 5,479,177

[45] Date of Patent: Dec. 26, 1995

[54] PHASED ARRAY ANTENNA SYSTEM TO PRODUCE WIDE-OPEN COVERAGE OF A WIDE ANGULAR SECTOR WITH HIGH DIRECTIVE GAIN AND WIDE FREQUENCY BANDWIDTH

[75] Inventors: Ronald M. Rudish, Commack; Scott F. Hall, Plainview, both of N.Y.

[73] Assignee: AIL Systems Inc., Deer Park, N.Y.

[21] Appl. No.: 700,929

[22] Filed: Nov. 20, 1984

[51] Int. Cl.[6] ..... H01Q 3/22

[52] U.S. Cl. ..... 342/375

[58] Field of Search ..... 343/373, 375, 343/382

[56] References Cited

U.S. PATENT DOCUMENTS 4,356,462 10/1982 Bowman ..... 343/375

4,544,927 10/1985 Kurth et al. ..... 343/373

*Primary Examiner*—Theodore M. Blum

*Attorney, Agent, or Firm*—Oldham & Oldham Co.

[57] ABSTRACT

A phased array antenna system capable of scanning at rates faster than the information rate of signals being received to prevent the loss of information during the scanning process. The sensitivity loss due to sampling usually encountered is avoided. The present invention is an improvement on a prior art system that avoids the sensitivity loss in that the present invention also avoids the frequency selectivity inherent in the prior art system.

The array antenna system is comprised of the means to form multiple, time-sequenced outputs, each output corresponding to a different beam of sensitivity. The beams scan the full coverage sector and together with the other outputs form a contiguous set of beams that both fill the coverage sector at any one time and also synchronously scan the full coverage sector. A differential delay network incorporating delay lines, envelope detectors and a summing junction is used to combine the outputs from the multiple beams to ensure that the responses to a single emitting source are added in unison in a manner which is not restrictive of frequency bandwidth. This arrangement retains the wide-open angular reception characteristics of a wide-beam omnidirectional antenna, while exhibiting the gain and angular resolution of a multi-element phased array antenna.

4 Claims, 3 Drawing Sheets

PHASED ARRAY ANTENNA SYSTEM TO PRODUCE WIDE-OPEN COVERAGE OF A WIDE ANGULAR SECTOR WITH HIGH DIRECTIVE GAIN AND WIDE FREQUENCY BANDWIDTH

TECHNICAL FIELD

This invention relates to electronically scanned receiving antenna systems which scan at rates faster than the information rate of the signals being processed and, more particularly, to improvements in the signal combining subsystem of such systems to simultaneously achieve wide frequency bandwidth and high values of gain by eliminating sampling loss.

BACKGROUND ART

In some instances, it is desirable to configure a system to receive all of the electromagnetic signals within the receiver's capability dictated by its sensitivity and bandwidth limitations. Usually the signals of Interest are incident from widely diverse directions. Thus, in one principal method, an antenna having a wide azimuth beamwidth, such as an omnidirectional antenna, is chosen as the system's receptor element.

The low-directive gain of such antennas is a severe limitation on the system sensitivity. In addition, the wide beamwidth does not permit directional resolution of multiple signals. Such resolution is usually desired to prevent garbling of signals that cannot otherwise be resolved in frequency or time-of-occurrence. Directional resolution is also useful in cases where the direction of incidence of the signals is to be estimated.

To overcome these disadvantages, alternative systems have been configured using high-gain narrow-beam antennas. In one such system, a narrow-beam is scanned over the azimuth coverage sector (either by mechanical motion of the antenna or by use of electronically controllable phase shifters). The disadvantage of this system is that the beam cannot look everywhere at once. This is especially a problem for multiple signals from diverse directions if they have rapidly changing waveforms (high information rate or short-pulse signals). These signals may hoe be sampled at a sufficiently high rate by the scanning beam to prevent information loss.

In another system, the antenna is configured to form multiple, narrow beams, that are contiguous and fixed in direction. Each beam port of the antenna is connected to a separate receiver. If the number of beams is sufficient to cover the entire azimuth sector of interest, then the system can exhibit the advantages of high directive gain (high sensitivity), good directional resolution (direction estimate and suppression of garble), and complete, simultaneous directional coverage (no information loss). However, the disadvantage of this system is the high cost of the multiple receivers.

Still another group of alternative systems have been configured to overcome these disadvantages by scanning a narrow beam at scanning rates so high that the beam will intercept each signal at least twice as often as its information rate. Thus, in the case of pulsed signals, the beam is caused to scan through its complete coverage sector within the time period of the shortest pulse expected. Such rapid scan is obtained by heterodyne techniques. This results in bandwidth spreading of the received signals, which, in the case of a pulsed signal, yields a predictably compressed pulse whose time of occurrence is directly related to the emitter azimuth location.

Early embodiments of array antennas using this rapid-scan heterodyne technique suffered a sampling loss which degraded sensitivity. This loss of signal (relative to the maximum signal energy available) is caused by the fact that the signal received by each radiator is summed coherently for only the portion of the scanning period during which the beam is pointing nearly in the direction of signal incidence. During the rest of the scan period, the signal received by each radiator is coherently summed at the resistor-terminated ports of the combiner (if it is a resistively isolated type of combiner) or is reflected back from the combiner to the radiators (in the case of a non-isolated type of combiner). The sampling loss in dB for an N element array is given by 10 log N; this is approximately the same numerical value as the gain of the array (relative to the gain of a single element). Although this antenna system can resolve emitters in azimuth as well as a conventional N element array, it provides only the sensitivity that can be attained with only a single element of that array.

A recent embodiment of an array antenna using this rapid-scan heterodyne technique (patent application Ser. No. 519,161, filed August 1983 by R. M. Rudish) overcame the sampling loss deficiency of the earlier embodiments by providing a multibeam capability. The earlier embodiments scan a single beam, whereas the recent embodiment uses a multiple beam-forming device such as a Butler matrix to produce and scan a comb of multiple contiguous beams in unison. At any instant, the beams are spread over the entire coverage sector of the antenna. At all times, at least one of the beams will be directed at any emitter within the antenna's coverage. The beams are displaced from each other in direction by approximately their beamwidths. They are also displaced from each other in time; that is, the time at which a particular beam coincides with a given direction differs from that at which each of the other beams coincide with that same direction. The time differences are known, fixed amounts related to the scan rate. Thus, by using a tapped delay line summing network, the recent embodiment can impart just the right differential delays to the individual beams to make their outputs from any one emitter occur in unison so that they can be summed coherently. In this manner, the recent embodiment recovers the signal loss which occurred in the arrays of earlier systems due to sampling the signal during only a portion of its time of presence. Thus, full array gain can be realized for an increase in system sensitivity. Yet, because there is only a single, summed output, far fewer components are needed to complete the processing of that output than is the case for other types of multiple-beam-antenna/multiple-receiver systems.

The recent embodiment of this rapid-scan heterodyne technique will be described in greater detail for the case of an N-element array since it forms the foundation for the improvements of the present invention.

DISCLOSURE OF INVENTION

It is therefore an object of the present invention to provide an array antenna system capable of scanning through its complete coverage sector within the time period of the shortest pulse expected to be received, thereby maintaining the same high probability of intercepting such a signal as can be achieved with a single wide-beamwidth element of the array.

It is another object of the present invention to provide angular resolution of multiple signals and the ability to determine their direction of arrival commensurate with the narrow beamwidth achievable with a full N element array.

It is yet another object of the present invention to achieve most of the gain available from an N element array by recovering the signal loss which occurs in the arrays of other systems due to sampling the signals during only a portion of its time of presence.

It is an additional object of the present invention to gain the advantages of the above objects using fewer components than are required for multiple beam antenna systems that require separate, complete receivers for each beam.

It is another object of the present invention to gain the advantages of the above objects for incident signals that may range over a wider frequency bandwidth than in the case of the systems of the type shown in FIG. 1.

In general, an apparatus for eliminating the frequency selectivity of signal energy in high directivity antenna systems having a coverage sector through which the antenna system scans multiple beams at a rate that is faster than the information rate being received, comprising: (a) a linear phased array antenna comprising a row formed of a plurality of antenna elements, one of said antenna elements at one end of the row being designated the first element, while the remaining elements are designated by succeeding numbers in arithmetic progression across the row of antenna elements, and the antenna elements being considered as being positioned in the azimuth plane for reference purposes; (b) means for forming a plurality of beams of sensitivity coupled to said antenna elements, said plurality of beams of sensitivity being equal in number to the number of antenna elements in said row, the beams being contiguous and considered as lying in the azimuth plane for reference purposes, with each beam being generally evenly spaced from the adjacent beams in sin θ space, where θ is the angle away from boresight in the azimuthal plane, the spacing between beam center directions in sin θ space being generally proportional to the reciprocal of the number of antenna elements, and the beams, taken together to form a larger composite beam, span the entire azimuth coverage sector; (c) means coupled to said antenna elements for synchronously scanning each of the beams over the entire coverage sector, the beams maintaining their relative positions adjacent one another in sin θ space during scanning, the scanning being carried out periodically at a rate that is at least twice as fast as the highest information rate being received; (d) means coupled to said antenna elements for accepting signals received by each beam and differentially delaying said signals to cause their modulation envelopes to respond in unison to a single emitting source at a particular azimuth angle within the sector coverage of the antenna system; and (e) means for noncoherently combining said signals after said signals have been differentially delayed.

PRIOR ART TECHNIQUE

Figure 1:
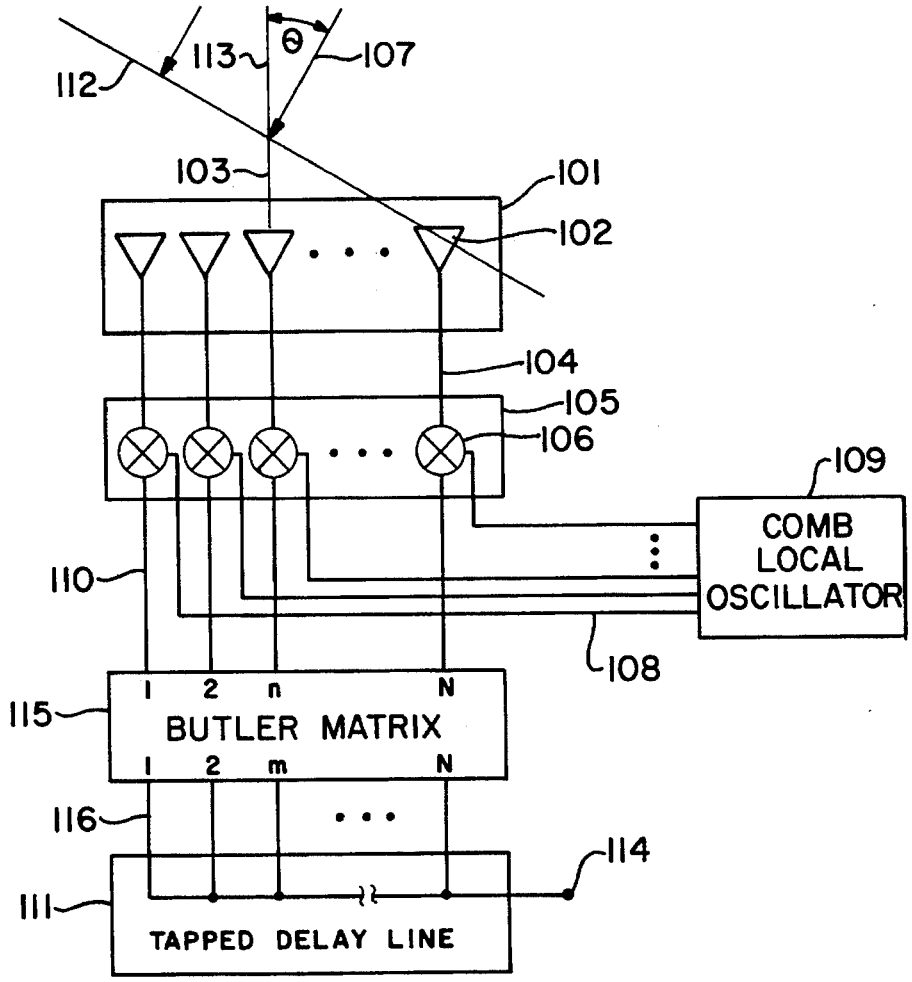
FIG. 1 is a block diagram of a prior art phased array antenna and receiver front-end which uses a heterodyne technique to scan a cluster of contiguous beams through the angular coverage region at a rate faster than the information rate of the signals being processed.

The principle of the recent embodiment is illustrated in FIG. 1 which contains a block diagram of an antenna and receiver front-end. The component elements shown in FIG. 1 comprise a linear array of N antenna elements 101, an end antenna element 102 and an nth element 103, N equal-length transmission lines 104 which connect elements 101 to N heterodyne mixers 105, an end mixer 106, N equal length transmission lines 108 which connect mixers 105 to a comb local oscillator 109, N equal length transmission lines 110 which connect the mixers 105 to Butler matrix 115, N equal length transmission lines 116 which connect Butler matrix 115 to tapped delay line signal-combiner 111, and output port 114. Amplifiers could be inserted before and after the mixers in a practical implementation, but they have been omitted from FIG. 1 because their presence is not required for the purpose of explaining the approach.

A detailed description of how the components of FIG. 1 function to obtain high directive gain with angular and frequency resolution follows for the case where a single CW signal is incident.

As shown in FIG. 1, an obliquely incident wavefront 112 induces RF signals, in the antenna elements 101, the signal induced in the nth element 103 being expressed as $e_n$. These signals are progressively delayed by an amount $\phi_S$, where $\phi_S$ is the phase difference between the signals received by adjacent elements. Numerically, $\phi_S=(2\pi d/\lambda_S)\sin\theta$ where $\lambda_S$ is the wavelength of the incident signal, d is the interelement spacing and θ is the angle between the direction of incidence 107 and the array normal 113. Therefore $e_n$ is given by:

$$e_n=\text{Cos}\,[\omega_S t+(n-\bar{n})\phi] \quad (1)$$

where $\omega_S$=the radian frequency of the incident signal; $\bar{n}=(N+1)/2$; and N=the total number of elements.

These signals are applied to the mixers 105. Also applied to the mixers are a set of coherently related local oscillator (LO) signals. These are generated by the comb local oscillator 109. Each LO signal differs in frequency by integer multiples of a constant frequency offset, $\omega_1$. The LO signals are coherent in the sense that once every cycle of the offset frequency, all of the LO signals reach the peak of their positive half cyles simultaneously. Numerically, the nth LO frequency is given by:

$$\omega_{LO}=\bar{\omega}_{LO}+(n-\bar{n})\omega_l$$

where $\bar{\omega}_{LO}$ is the average LO frequency. Because of the progressive frequency difference, the LO signals exhibit a time-varying phase advance, $\phi_{LO}=(n-n)\omega_1 t$.

The IF signals produced by the mixers are progressively phased in accordance with the difference of RF and LO progressive phasing, as may be noted from the expression for the IF signal, $$e_{IF}=\text{COS}\,[\bar{\omega}_{IF}t-(n-\bar{n})(\omega_l t-\phi]$$

and $$\bar{\omega}_{IF}=_s-\bar{\omega}_{LO}$$

Thus, the inputs to the Butler matrix are a set of equal amplitude IF signals having a phase progression that is linear with n and with time. In a practical system, amplitude tapering (weighting) might be applied to the signals prior to their entrance into the Butler matrix, for radiation pattern sidelobe control. However, this detail has been omitted from FIG. 1 because it is not required in order to explain the approach.

The Butler matrix divides the signal at its nth input in N equal parts, phase shifts each by an amount, $\phi_B$, and combines each with signals which originated from other ports to form the sum, $e_m$, at its mth output. The phase shift, $\phi_B$, is dependent on both m and n and is given by:

$$\phi_B = (n-\bar{n})(m-\bar{n})\frac{2\pi}{N} \quad ,(\phi_B \text{ is modulo } 2\pi)$$

Thus, the output voltage, $e_m$, is the summation:

$$e_m = \frac{1}{\sqrt{N}} \sum_{n=1}^{n=N} \text{Cos}\left[ \overline{W}_{IF} - (n-\bar{n})(W_1 t - \phi) + (n-\bar{n})(m-\bar{n})\frac{2\pi}{N} \right]$$

where $\sqrt{N}$ factor accounts for the N-way power division. It can be shown that the summation equates to the form:

$$e_m = \frac{E_m}{\sqrt{N}} \text{Cos}(W_{IF} t) \tag{2}$$

where:

$$E_m = \frac{\text{SIN}(^1/_2 N X_m)}{\text{SIN}(1/2 X_m)} \quad , X_m = \phi - W_1 t + (m-\bar{n})\frac{2\pi}{N}$$

Figure 2:
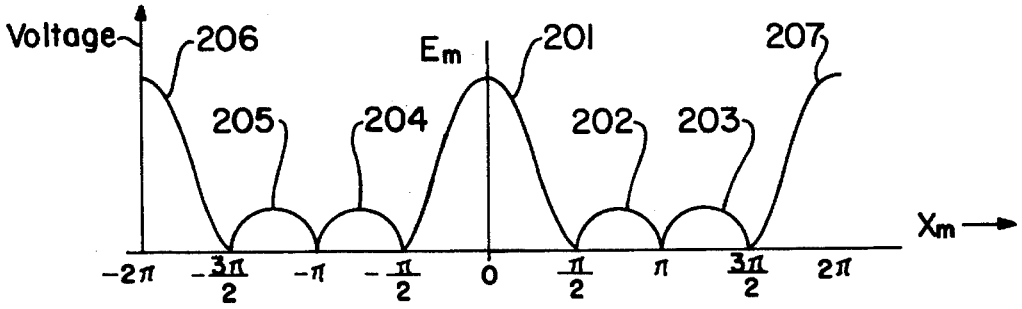
FIG. 2 is a graph of the envelope factor magnitude, $|E_m|$, of an output voltage of the Butler matrix in the system of FIG. 1, plotted against the composite variable $X_m$.
Figure 3:
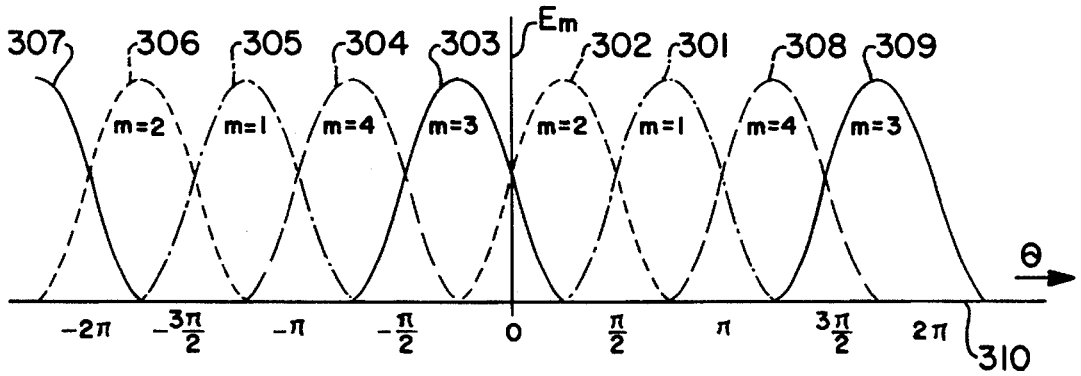
FIG. 3 is a graph of the envelope factor magnitude, $|E_m|$, of an output voltage of the Butler matrix in the system of FIG. 1, plotted against the constituent variable φ.

It may be noted from these expressions that each Butler matrix output, $e_m$ is the product of an envelope term, $E_m$, and a carrier term. The envelope magnitude $|E_m|$ is plotted for N=4 in FIG. 2 as a function of $X_m$. The curve is a periodic function of $X_m$, having a mainlobe 201, sidelobes 202, 203, 204 and 205 and grating lobes 206 and 207 within the range plotted. The envelope term $|E_m|$ is again plotted in FIG. 3; in this case it is plotted as a function of $\phi$ which is one of the constituents of $X_m$, and it is assumed that $\omega_1 t$, another constituent, is held at zero. Since $\phi$ is a function of $\theta$, FIG. 3 shows the directional dependence $|E_m|$. Four curves are plotted using different line codes, one for each of the four Butler matrix outputs. Only the mainlobes 301, 302, 303 and 304 and grating lobes 305, 306, 307, 308 and 309 are shown; the sidelobes have been suppressed for purposes of clarity. Taken together, the four curves form a continuous set which provides outputs for all values of $\phi$ (and thus all values of $\theta$). These outputs correspond to a set of contiguous beams of sensitivity which together span the entire coverage sector.

Figure 4:
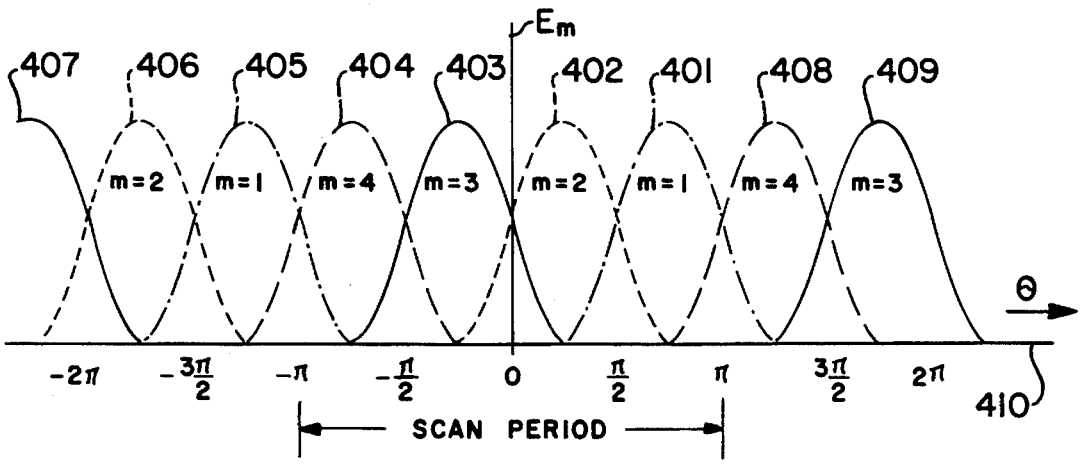
FIG. 4 is a graph of the envelope factor magnitude, $|E_m|$, of an output voltage of the Butler matrix in the system of FIG. 1, plotted against the constituent variable $-\omega_1 t$.

The envelope term $|E_m|$ is once again plotted in FIG. 4; in this case it is plotted as a function of $-\omega_1 t$ (the second constituent of $X_m$) and $\phi$ (the first constituent) is held constant at zero. Except for the relabeling of the abscissa (the $\phi$ axis 310 becomes the $-\omega_1 t$ axis 410) the curves of FIG. 4 are identical with those of FIG. 3, which is not surprising since a given value of $X_m$ can result from either a specific value of direction or a specific value of time. FIG. 4 shows that the lobes of the output envelope $|E_m|$ at each Butler port peaks at specific times which are staggered relative to the peaks at other ports. These lobes are, in effect, the responses of an N beam, N element array antenna whose beams are being scanned past the direction of an emitter in sequence, smoothly with time.

Each of the beams is only on target for 1/N of the scan period. Thus, each beam samples only 1/Nth the signal energy available at the radiators. However, all the beams, taken together, sample all the signal energy. To get all the energy at a single output requires that the multiple time-sequenced outputs of the Butler matrix be coherently summed. That in turn requires that both the carriers and envelopes of these outputs be brought into phase unison.

In the system shown in FIG. 1, the tapped delay line combiner 111 is configured to progressively delay the envelopes by the amount $T_m$, where:

$$T_m = \left(\frac{m-n}{W_1}\right)\left(\frac{2\pi}{N}\right) + \text{a constant} \tag{3}$$

The delay operation causes all the envelopes to peak at the same time. However, this delay operation causes the phase of each carrier to be displaced by several cycles from that of the other carriers, the exact amount of displacement being a linear function of $\overline{\omega}_{IF}$. Periodically, over the $\overline{\omega}_{IF}$ frequency band, the carrier phases will be an integral multiple of 2 $\pi$ radians apart and thus, effectively cophasal. For signals which produce these values of $\overline{\omega}_{IF}$, the outputs of the Butler matrix are coherently summed by the tapped delay line combiner to obtain all the available signal energy. For other frequencies, the carriers will be in various states of partial or complete destructive interference and so will combine to values less than the peak value. Mathematically, the output of the tapped delay line combiner appearing at port 114 (the sum of the differentially delayed outputs), $e_S$, is given by:

$$e_S \frac{1}{\sqrt{N}} \text{Cos}\overline{W}_{IF} t \times \frac{\sin^1/_2 N(\phi - W_1 t)}{\sin 1/2(\phi - W_1 t)} \times \frac{\sin^1/_2 N\left(\frac{\overline{W}_{IF}}{W_1}\right)\left(\frac{2\pi}{N}\right)}{\sin^1/_2\left(\frac{W_{IF}}{W_1}\right)\left(\frac{2\pi}{N}\right)}$$

This function is a doubly-modulated carrier. The first envelope term is similar to the one which modulates $e_m$ and was the subject of discussion in connection with FIG. 2. The second envelope has the same form, but is a function of frequency rather than time or incidence angle. This second (frequency) envelope expresses the multiple bandpass filter action of the delay-and-add operations on the Butler matrix output. The filtering is a result of phase cancellations rather than the frequency responses of the components (which are wideband). The width of each passband is 2 $\omega_1$ measured between nulls (or $\omega_1$ measured between points that are 3.9 dB down on the frequency envelope). This bandwidth expresses the range that the average frequency of the IF signal might have if it is to be passed, and as such, specifies the range over which the incident RF signal frequency might vary and still be accepted. It should be distinguished from the instantaneous bandwidth of the IF signal at output terminal 114 which is $N\omega_1$ (in the case of an incident signal that is CW or of bandwidth small compared to $N\omega_1$).

The bandpass filter action of the arrangement shown in FIG. 1 may be perfectly acceptable in those applications where $\omega_1$ can be chosen large enough so that all the incident signals of interest lie within $\omega_1$. However, there are many applications where this bandpass filter action is a disadvantage because the desired RF bandwidth is too large to accommodate by expansion of $\omega_1$. This is because such expansion would be accompanied by a parallel expansion of the output pulse spectrum to an undesirably large bandwidth. It is the purpose of the present invention to overcome this bandwidth limitation by appropriate modification of the system described in FIG. 1.

BEST MODE FOR CARRYING OUT THE INVENTION

The present invention overcomes the frequency bandwidth deficiency of the system shown in FIG. 1 and provides all of the advantages of the aforementioned objectives simultaneously with a single configuration.

The antenna system of the present invention achieves the same rapid scan provided by the system of FIG. 1 and also provides a multibeam capability. The system of FIG. 1 coherently combines the multiple beams after adding delays whereas the system of the present invention noncoherently combines the beams after addition of the delays and envelope detection of the beams.

Noncoherent addition of signals avoids the phase interference and partial or complete cancellation of signals which occurs for signals of certain frequencies in the system of FIG. 1. Thus, those signals which were rejected by the system of FIG. 1 because the delayed beams produced by these signals were not cophasal, would be received by the system of the present invention. The disadvantage usually ascribed to noncoherent addition is that it produces less gain than coherent addition. However, at the signal-to-noise ratios at which practical implementations of the present invention would operate, the gain penalty for noncoherent rather than coherent addition is small compared to the available array gain. Thus, the present invention can provide nearly as much gain as the system of FIG. 1 but without suffering the frequency bandwidth limitations of the FIG. 1 system.

Figure 5:
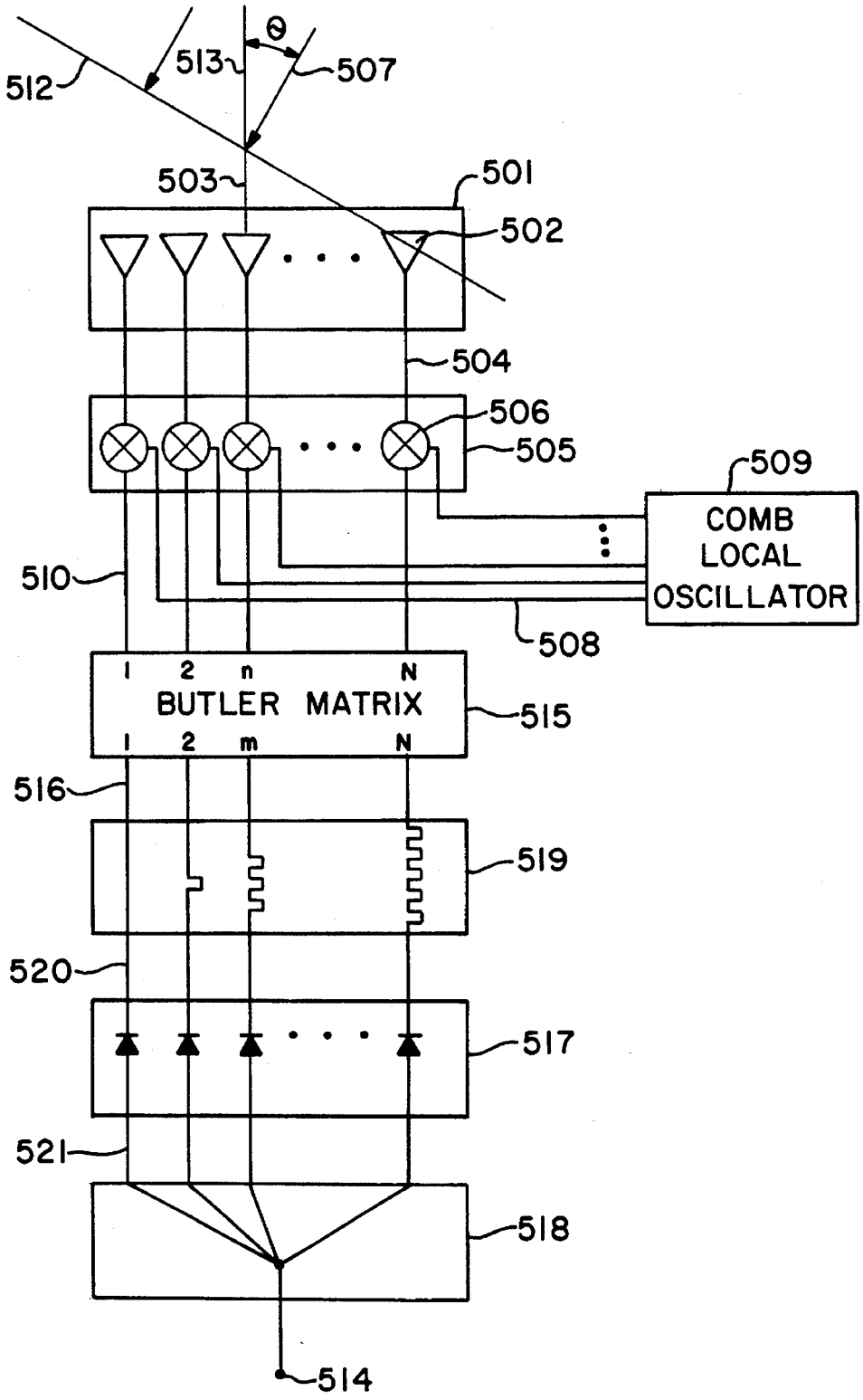
FIG. 5 is a block diagram of a phased array antenna and receiver front-end, illustrating the present invention.

To clearly illustrate various novel aspects of the current invention, a specific example is taken in which an N element linear array incorporating the invention is exposed to a signal wavefront incident from a direction θ with respect to the array normal. This embodiment is shown in FIG. 5. The diagram of FIG. 5 comprises a linear array of N antenna elements 501, end antenna element 502 and nth element 503, N equal length transmission lines 504 which connect elements 501 to N heterodyne mixers 505, and end mixer 506, N equal length transmission lines 508 which connect mixers 505 to a comb local oscillator 509, N equal length transmission lines 510 which connect mixers 505 to Butler matrix 515, N equal length transmission lines 516 which connect Butler matrix 515 to a set of N delay lines of progressively differing length 519, N equal length transmission lines 520 which connect the delay lines 519 with a set of N envelope detectors 517, N transmission lines 521 which connect the envelope detectors 517 with a summing junction 518 and output port 514.

An obliquely incident wavefront 512 induces RF signals in the antenna elements 101, these signals being delayed progressively by an amount which is dependent on the angle of incidence, θ, which is the angle measured between the direction of signal incidence 507 and the array normal 513. The signal induced in the nth element 103 is given by $e_n$, where the expression for $e_n$ is the same (equation 1) as that described earlier in connection with the system of FIG. 1. Indeed, the outputs of the comb local oscillator 509, the mixers 505 and the Butler matrix 515 are all as described earlier in parallel references to similar points in the system of FIG. 1. Thus, the signals which are applied to the delay lines 519 are given by the N values of $e_m$, where the expression for $e_m$ is the same as that expressed earlier (equation 2). The delay lines 519 progressively delay the signals, $e_m$ by the amounts $T_m$, where the expression for $T_m$ is as before (equation 3). As in the case of the system of FIG. 1, the delay lines 519 remove the m dependent terms from the signal envelope (causing them to peak at the same time) but adds m dependence to the carriers. Thus, the signals which are applied to the envelope detectors 517 are of the form $e_t$ where:

$$e_t = \frac{1}{\sqrt{N}} \frac{\sin[{}^1/_2 N(\phi - W_1 t)]}{\sin[{}^1/_2(\phi - W_1 t)]} \cos\left[ \overline{W}_{IF} t + (m - \bar{n}) \frac{\overline{W}_{IF}}{W_1} \frac{2\pi}{N} \right]$$

The envelope detectors 517 effectively strip the carriers and provide output voltages proportional to the envelopes. These are combined at summing junction 518 to yield the signal voltage $e'_s$, at output port 514, where:

$$e_s' \propto \frac{N}{\sqrt{N}} \frac{\sin[1/2N(\phi - W_1 t)]}{\sin[1/2(\phi - W_1 t)]}$$

This output signal is a compressed pulse which peaks at a time which depends on the signal incidence angle and which recurs at an angular frequency $\overline{\omega}_1$. The output signal is independent of $\overline{\omega}_{IF}$ which is in contrast to the case of the output signal $e_s$ in the case of the system of FIG. 1.

An analysis of how the receiver front end noise traverses the system to the output port 514 shows that the signal-to-noise ratio is slightly less than that achieved by the system of FIG. 1. The difference in signal-to-noise ratio is exactly the difference between coherent and noncoherent integration gains. In a typical case of interest (N=8, output signal-to-noise ratio 14 dB), the difference in sensitivity between coherent and noncoherent integration is about 1.3 dB, so that the directive gain in sensitivity achieved by combining the multiple scanning beams of the current invention is 7.7 dB rather than the 9 dB directive gain achievable with the system of FIG. 1 (relative to that achievable with a single scanning beam). In many applications, this small loss in sensitivity is an acceptable price for the advantage of having $e'_s$ independent of $\overline{\omega}_{IF}$.

Alternative equivalent systems are considered within the scope of the invention. For example, alternative systems derived by the addition of a set of amplifiers prior to the mixing process or after the mixing process or the addition of preselector filters or attenuators or receive/transmit duplexers or any other set of devices normally found in the front end of a receiver are considered within the contemplations of the current invention because these devices do not alter the intent or the manner of operation of the invention, although to the extent that the transmission parameters of such devices fail to track each other, they can degrade performance.

All of the alternative equivalent forms of the invention have in common the following essence of the invention: the means to form multiple, time-sequenced outputs, each output corresponding to a different beam of sensitivity which scans the full coverage sector and together with the other outputs forms a contiguous set of such beams which both fill the coverage sector at any one time and scan the full coverage synchronously as a function of time; the means to differentially delay the time-sequenced outputs corresponding to an emitter at a fixed direction, so that the modulation envelopes of these outputs occur in unison; and the means to noncoherently combine the time-aligned outputs. Although an azimuth plane is used for reference purposes, the present invention is capable of functioning in the same manner regardless of the plane in which the antenna elements lie.

While in accordance with the patent statutes, only the best mode and preferred embodiment of the present invention has been presented in detail, for the true scope and breadth of the invention, reference should be had to the appended claims.

What is claimed is:

1. Apparatus for eliminating the frequency selectivity of signal energy in high directivity antenna systems having a coverage sector through which the antenna system scans multiple beams at a rate that is faster than the information rate being received, comprising:

(a) a linear phased array antenna comprising a row formed of a plurality of antenna elements, one of said antenna elements at one end of the row being designated the first element, while the remaining elements are designated by succeeding numbers in arithmetic progression across the row of antenna elements, and the antenna elements being considered as being positioned in the azimuth plane for reference purposes;

(b) means for forming a plurality of beams of sensitivity coupled to said antenna elements, said plurality of beams of sensitivity being equal in number to the number of antenna elements in said row, the beams being contiguous and considered as lying in the azimuth plane for reference purposes, with each beam being generally evenly spaced from the adjacent beams in sin θ space, where θ is the angle away from boresight in the azimuthal plane, the spacing between beam center directions in sin θ space being generally proportional to the reciprocal of the number of antenna elements, and the beams, taken together to form a larger composite beam, span the entire azimuth coverage sector;

(c) means coupled to said antenna elements for synchronously scanning each of the beams over the entire coverage sector, the beams maintaining their relative positions adjacent one another in sin θ space during scanning, the scanning being carried out periodically at a rate that is at least twice as fast as the highest information rate being received;

(d) means coupled to said antenna elements for accepting signals received by each beam and differentially delaying said signals to cause their modulation envelopes to respond in unison to a single emitting source at a particular azimuth angle within the sector coverage of the antenna system;

(e) means for non-coherently combining said signals after said signals have been differentially delayed, said noncoherently combining means comprising means for envelope detecting and means for combining said envelopes.

2. An apparatus as in claim 1, further comprising:

(a) a plurality of heterodyne mixers, equal in number to the number of antenna elements, each having an input port, an output port and a local oscillator port, each input port being coupled to a separate antenna element for frequency conversion of the signals received by said antenna elements, and each mixer being designated by the same number as the antenna element to which it is coupled;

(b) means for generating a plurality of local oscillator signals equal in number to the number of mixers, each local oscillator signal being separately coupled to one of said plurality of mixers by way of its local oscillator port and each of said plurality of local oscillator signals assuming the same numerical designation as the mixer to which it is coupled, the frequency of each local oscillator signal being offset from that of the proceeding one in the order of its arithmetic designation to order the frequencies of the local oscillators from the first to the last in a linear arithmetic progression with a common difference equal to the beam scanning rate, the means for generating the local oscillator signals producing coherently related local oscillator signals in that, at the same point in each cycle of the common difference frequency, the sinusoidal variations of the local oscillator signals simultaneously reach their peaks;

(c) said means for forming a plurality of contiguous beams of sensitivity each designated by succeeding numbers in arithmetic progression in accordance with its position in the beam group, said means comprising an intermediate frequency beam-forming network having a plurality of input ports equal to the number of mixers, with each of said input ports being coupled to a separate output port of one of said mixers, and said intermediate frequency beam-forming network having a plurality of output ports equal to the number of beams, with each of said output ports being designated by the same number designation of the beam to which it couples;

(d) said means for differentially delaying a plurality of signals comprising a plurality of delay lines equal in number to the number of beams, each having an input port and an output port, each input port being coupled to an output of the beam-forming network output port to which it is coupled, the delay of each delay line being offset from that of the proceeding one in the order of its arithmetic designation to order the delays of the delay-lines from the first to the last in a linear arithmetic progression with a common difference equal to the reciprocal of the product of the number of beams times the beam scanning rate; and (e) said means for noncoherently combining a plurality of signals comprising a plurality of envelope detectors and a video frequency signal combiner, said envelope detectors being equal in number to the number of delay lines, each envelope detector having an input port and an output port with each input port of an envelope detector being coupled to the output port of a delay line, said video frequency signal combiner having a single output port and a plurality of input ports equal in number to the number of envelope detectors, with each input port of the signal combiner being coupled to an output port of an envelope detector.

3. A process for eliminating the frequency selectivity of signal energy in high directivity antenna systems having a coverage sector through which the antenna systems scan multiple beams at a rate that is faster than the information rate being received, comprising the steps of:

(a) providing a linear phased array antenna comprising a row formed of a plurality of antenna elements, one of said antenna elements at one end of the row being designated the first element, while the remaining elements are designated by succeeding numbers in arithmetic progression across the row of antenna elements, and the antenna elements being considered as being positioned in the azimuth plane for reference purposes;

(b) providing means for forming a plurality of beams of sensitivity coupled to said antenna elements, said plurality of sensitivity being equal in number to the number of antenna elements in said row, the beams being contiguous and considered as lying in the azimuth plane for reference purposes, with each beam being generally evenly spaced from the adjacent beams in sin θ space, where θ is the angle away from boresight in the azimuthal plane, the spacing between beam center directions in sin θ space being generally proportional to the reciprocal of the number of antenna elements, and the beams, taken together to form a larger composite beam, span the entire azimuth coverage sector;

(c) providing means coupled to said antenna elements for synchronously scanning each of the beams over the entire coverage sector, the beams maintaining their relative positions adjacent one another in sin θ space during scanning, the scanning being carried out periodically at a rate that is at least twice as fast as the highest information rate being received;

(d) providing means coupled to said antenna elements for accepting signals received by each beam and differentially delaying said signals to cause their modulation envelopes to respond in unison to a single emitting source at a particular azimuth angle within the sector coverage of the antenna system; and (e) providing means for noncoherently combining said signals after said signals have been differentially delayed, said non-coherently combining means comprising means for envelope detecting and means for combining said envelopes.

4. A process as in claim 3, further comprising the steps of:

(a) providing a plurality of heterodyne mixers, equal in number to the number of antenna elements, each having an input port, an output port and a local oscillator port, each input port being coupled to a separate antenna element for frequency conversion of the signals received by said antenna elements, and each mixer being designated by the same numbers as the antenna element to which it is coupled;

(b) providing means for generating a plurality of local oscillator signals equal in number to the number of mixers, each local oscillator signal being separately coupled to one of said plurality of mixers by way of its local oscillator port and each of said plurality of local oscillator signals assuming the same numerical designation as the mixer to which it is coupled, the frequency of each local oscillator signal being offset from that of the proceeding one in the order of its arithmetic designation to order the frequencies of the local oscillators from the first to the last in a linear arithmetic progression with a common difference equal to the beam-scanning rate, the means for generating the local oscillator signals producing coherently related local oscillator signals in that, at the same point in each cycle of the common difference frequency, the sinusoidal variations of the local oscillator signals simultaneously reach their peaks;

(c) providing said means for forming a plurality of contiguous beams of sensitivity each designated by succeeding numbers in arithmetic progression in accordance with its position in the beam group, said means comprising an intermediate frequency beam-forming network having a plurality of input ports equal to the number of mixers, with each of said input ports being coupled to a separate output port of one of said mixers, and said intermediate frequency beam-forming network having a plurality of output ports equal to the number of beams, with each of said output ports being designated by the same number designation of the beam to which it couples;

(d) providing said means for differentially delaying a plurality of signals comprising a plurality of delay lines equal in number to the number of beams, each having an input port and an output port, each input port being coupled to an output of the beam-forming network output port to which it is coupled, the delay of each delay line being offset from that of the proceeding one in the order of its arithmetic designation to order the delays of the delay-lines from the first to the last in a linear arithmetic progression with a common difference equal to the reciprocal of the product of the number of beams times the beam scanning rate; and (e) providing said means for noncoherently combining a plurality of signals comprising a plurality of envelope detectors and a video frequency signal combiner, said envelope detectors being equal in number to the number of delay lines, each envelope detector having an input port and an output port with each input port of an envelope detector being coupled to the output port of a delay line, said video frequency signal combiner having a single output port and a plurality of input ports equal in number to the number of envelope detectors, with each input port of the signal combiner being coupled to an output port of an envelope detector.

* * * * *